US005653644A

United States Patent [19]

Jaeckel

[11] Patent Number: 5,653,644

[45] Date of Patent: Aug. 5, 1997

[54] GOLF PUTTER SHAFT

[76] Inventor: W. Jake Jaeckel, 6120 Country Club Way, #107, Sarasota, Fla. 34243

[21] Appl. No.: 591,338

[22] Filed: Jan. 25, 1996

[51] Int. Cl.[6] ..... A63B 53/14

[52] U.S. Cl. ..... 473/303; 473/316

[58] Field of Search ..... 473/201, 202, 473/203, 256, 300, 301, 302, 303, 304, 316, 317, 321, 323

[56] References Cited

U.S. PATENT DOCUMENTS

| | | | |
|---|---|---|---|
| D. 93,756 | 11/1934 | Barnhart . | |
| D. 120,332 | 5/1940 | Barnhart . | |
| D. 120,333 | 5/1940 | Barnhart . | |
| 1,506,523 | 8/1924 | Gordon | 473/201 |
| 1,653,428 | 12/1927 | Brinkman . | |
| 1,677,099 | 7/1928 | Harness . | |
| 1,890,037 | 12/1932 | Johnson . | |
| 1,974,271 | 9/1934 | Hackett . | |
| 2,066,962 | 1/1937 | Cross . | |
| 3,231,281 | 1/1966 | Wallo | 473/256 |
| 3,809,403 | 5/1974 | Hunter . | |
| 4,179,125 | 12/1979 | Cone et al. . | |
| 4,215,860 | 8/1980 | Nakamatsu | 473/201 |
| 4,537,403 | 8/1985 | Farina | 473/316 |
| 4,746,120 | 5/1988 | Mockovak | 473/301 |
| 4,795,158 | 1/1989 | Kuykendall | 473/201 |
| 4,954,198 | 9/1990 | Viellard . | |
| 5,152,527 | 10/1992 | Mather | 473/297 |

*Primary Examiner*—Sebastiano Passaniti
*Attorney, Agent, or Firm*—Roth & Goldman

[57] ABSTRACT

A golf putter shaft having an integrally formed handle intended for use without a soft grip overwrapping having a handle section preferably of D shaped cross-section sized to assist the golfer to keep his wrists from breaking during putting. The putter shaft is preferably made from aluminum alloy of increased stiffness compared to ordinary golf club shafts. Supplementary weighting may be provided in the handle section to result in a putter having its balance point located near the mid-length of the shaft.

13 Claims, 2 Drawing Sheets

GOLF PUTTER SHAFT

CROSS REFERENCE TO RELATED APPLICATIONS, IF ANY NONE

BACKGROUND OF THE INVENTION AND PRIOR ART

The art of golf putters has been extremely well developed since the Scots first began playing the game centuries ago. Various materials have been used for golf club shafts, ranging from hickory and willow to metals and space-age technology graphite reinforced resin composites. At the present time, most golf club shafts are made of steel which is then chrome plated and a rubber or composition grip is then glued to the shaft. Steel shafts are usually continuously tapered or step-tapered from a thin tip end to the handle or butt end and are designed with flexibility characteristics for wood or iron head clubs intended to be swung for full or partial shots rather than for putters. These same steel shafts are then cut down to a length appropriate for putter shafts. Although the shortening increases the stiffness of the shaft, cut down steel shafts are generally less stiff than desired for putters. The butt end is of suitable diameter to receive a wound or sleeve type grip which increases the grip size to accommodate the hands of the golfer.

Ingenious golf putter developments in the past have resulted in various configurations including those having single and double bend steel shafts; straight steel shafts with or without fluting over a portion of their length; and straight shafts made of other materials such as fiberglass or graphite composites and alloys. Apart from special bends or fluting, most shafts used in prior art putters are ordinary steel shafts not specially constructed for putter use. The butt or handle ends of these shafts are of circular cross-section having a typical diameter in the range of from 0.580–0.600 inches for receiving a grip of rubber or leather or other non-slip generally soft material. The exterior grip configuration may vary within the Official Rules of Golf.

In direct contrast with golf club shafts intended for woods and irons where achieving maximum distance is one of the major objectives accomplished by cocking of the wrists on the backswing and uncocking or release of the wrists on the downswing to generate high club head speed, putters should have stiff shafts and the golfer's wrists preferably should not break when executing a putting stroke. Clubhead speed is generated best when the weight of the club is concentrated in the head. A good putting stroke is quite the opposite in that it is accepted wisdom in teaching circles that the golfer should not cock or break his wrists during the putting stroke. Instead, the triangle formed by the golfer's shoulders and arms is generally kept in a constant configuration to control speed and direction of the putt. This suggests that the ideal putter should have characteristics which assist the golfer in keeping his wrists stiff or firmly locked when putting. Accordingly, the handle should be configured (in conformity with the Official Rules of Golf) to assist the golfer in keeping his wrists firm during the putting stroke. Also, it is thought that the putter weight distribution need not emphasize weight of the club head but could and perhaps should instead place greater weight toward the handle end of the club such that the balance point is more toward the mid-point of the club shaft rather than only a few inches from the blade as is conventional.

SUMMARY OF THE INVENTION

The present invention provides a hollow shaft for a golf putter comprising:

a tip section;

a handle section having a substantially flat side; and a tapered section interconnecting said tip section and said handle section, said sections being integrally formed from a single piece of metal, said substantially flat side of said handle section having a width, measured in a plane generally perpendicular to the plane of a putter blade when affixed to the shaft, of not less than 0.930 inches.

The present invention further provides a golf putter comprising:

a putter blade having a ball striking face generally lying in a striking plane; and a hollow shaft having:

a tip section to which said putter blade is affixed;

a handle section having a substantially flat side; and a tapered section interconnecting said tip section and said handle section, said sections being integrally formed from a single piece of metal, said substantially flat side of said handle section having a width, measured in a plane generally perpendicular to the plane of said putter blade, of not less than 0.930 inches.

DESCRIPTION OF THE PREFERRED EMBODIMENT

Figure 1:
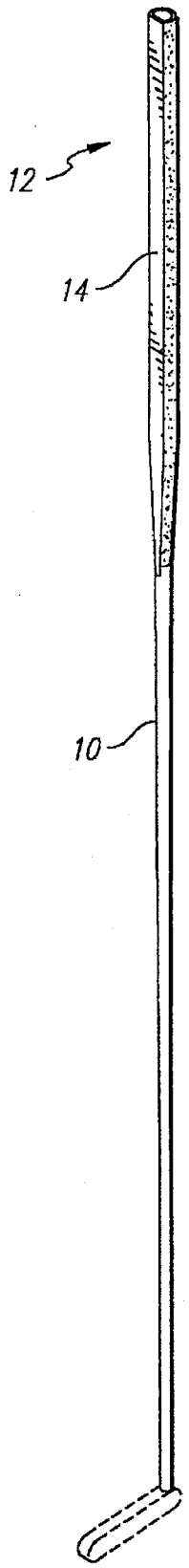
FIG. 1 is a perspective view of a golf putter employing the putter shaft of the present invention.
Figure 2:
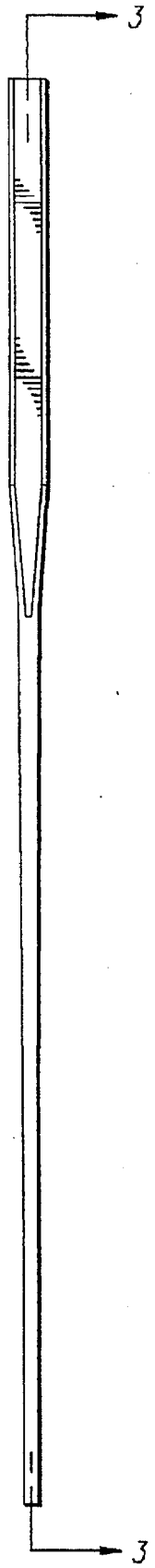
FIG. 2 is a front elevation of the golf putter shaft of the present invention.
Figure 3:
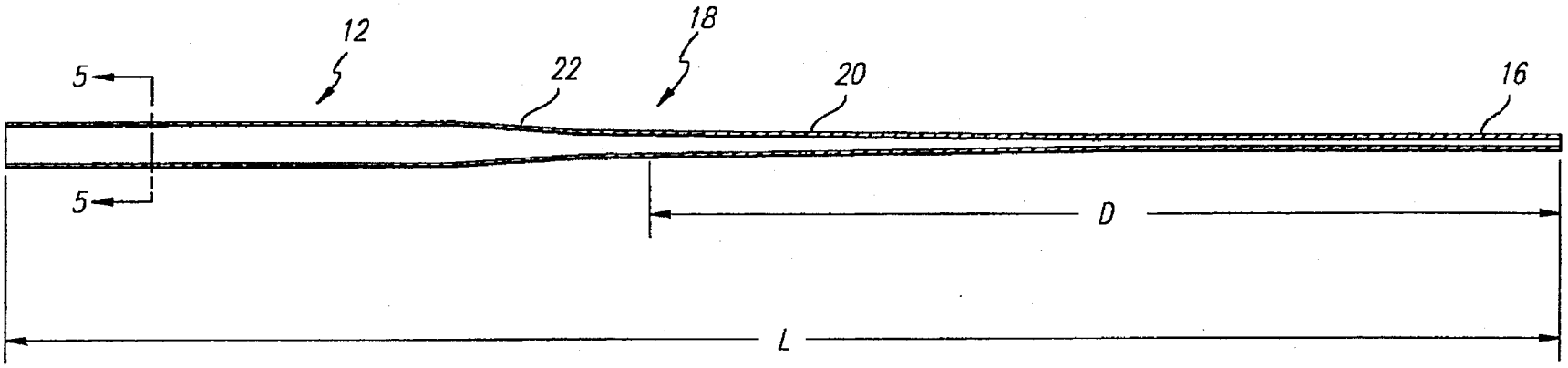
FIG. 3 is a longitudinal cross-section of the golf putter shaft of the present invention looking from the front of the shaft as seen in FIG. 2 drawn to an exaggerated scale for clarity.
Figure 4:
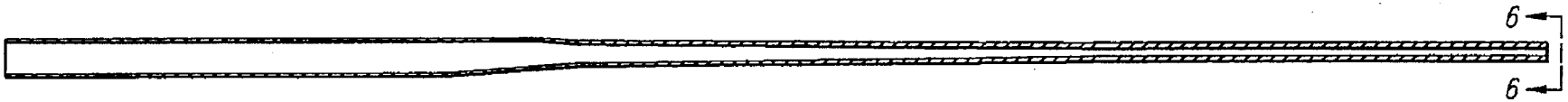
FIG. 4 is a longitudinal cross-section of the golf putter shaft of the present invention looking from the side of the shaft as seen in FIG. 2 drawn to an exaggerated scale for clarity.
Figure 5:
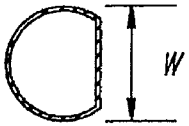
FIG. 5 is a cross-section looking in the direction of line 5—5 of FIG. 3.

The perspective view of a putter incorporating the teachings of the present invention as seen in FIG. 1 comprises an elongated putter shaft 10 having a putter blade B shown in phantom, suitably affixed to the tip end and having a generally circular cross-section including an integrally formed handle section 12 with a flattened side 14 facing perpendicular to the intended line of the putt. This flattened portion 14 conveniently provides a resting surface for the thumbs of the golfer and assists in preventing rotation of the putter handle in the golfer's hands during the putting stroke. The construction of the putter shaft is best understood with reference to the cross-sectional views of the invention seen in FIGS. 3–5. The putter shaft 10 is formed from a single stiff hollow tube, preferably aluminum, which is worked with common drawing, swaging or extrusion techniques to reform the originally cylindrical tube into an integral shaft comprised of the handle section 12, a tip section 16 and a tapered section 18 between the tip section and handle section. In the preferred embodiment shown in FIGS. 3 and 4, the tapered section 18 includes a first taper 20 and a second taper 22 although only one taper is necessary. The shaft is thus comprised of at least three sections 12, 16 and 18 integrally formed from a single piece of metal, preferably aluminum alloy, although other metals or alloys are also contemplated for future putter shaft constructions. The wall thickness of the putter shaft of the present invention varies along the length of the shaft from relatively thick at the tip end to relatively thin at the butt end unlike conventional shafts which have a substantially constant wall thickness.

Figure 6:
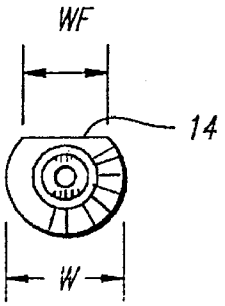
FIG. 6 is a tip or bottom end view.

Contrary to conventional putter shafts which have a handle receiving end with a maximum handle diameter of about 0.600 inches, the handle section of the present putter shaft does not have a circular cross section but has a width W, measured in a plane generally perpendicular to the plane of a putter blade when affixed to the shaft, of not less than 0.930 inches as seen in FIG. 6. This handle width is thus over 150% larger than the handle diameter of conventional putters. Although it is anticipated that various golfers, for whatever reasons, will wish to employ a soft grip cover on the handle section 12 of the putter shaft of the present invention, the putter shaft of the present invention is designed and intended for use without a soft cover. To that end, the curved side of handle section 12 of the putter shaft 10 is preferably shot peened to a roughened non-shiny appearance. Direct contact between the golfer's hands and the putter handle section 12 improves the golfer's feel for the putting stroke and the flattened handle side 14 provides a firm thumb rest which, with the roughened curved portion of the handle, assists the golfer in keeping his wrists locked and prevents the putter shaft from rotating in the golfer's hands during the putting stroke.

Specific Example

A putter was constructed by affixing a standard putter head weighing about 300 grams to a shaft formed from a single tube of aluminum and cut to a shaft length of 35 inches and weighing about 135 grams. The total weight of the putter, which included a thin grip on the handle section was about 470 grams. It will be appreciated that shafts can be of varying lengths in the range of approximately 32 inches through 38 inches depending on the height and preference of the golfer.

The tip section had a length of 10 inches with an outside diameter of 0.370 inches. The wall thickness of the aluminum tube at the tip end was 0.100 inches. The range of acceptable wall thicknesses for the tip section of the shaft is approximately from 0.065 inches through 0.105 inches.

The first taper 20 had an axial length of 12 inches and the second taper 22 had an axial length of 3 inches for a total length of tapered section 18 of 15 inches through which the wall thickness diminished as the diameter of the shaft increased toward the butt or handle section 12 which, in the manufactured embodiment, had an outside diameter or width W (FIG. 6) of 0.940 inches before flattening. It is contemplated that the outside diameter of the curved portion of the handle section 12 will be within the range of 0.930 inches through 0.950 inches for average golfers. The wall thickness of the tube in the handle section 12 was 0.034 inches but it is contemplated that the generally acceptable range of wall thickness in this section can very from approximately 0.030 inches through 0.045 inches. In the manufactured embodiment, the flattened side 14 of the handle extended for the full 10 inch length of the handle section and slightly into the tapered section 18. The width WF (FIG. 6) of the flattened section 14 was approximately 0.75 inches.

Supplementary weight may be provided in the handle section 12 of the shaft such that the balance point of a putter having a typical blade attached to the shaft is approximately in the mid-point of the shaft. More specifically, the balance point of the putter should be located a distance D measured from the tip end of the shaft in the range of from 40% to 60% of the length L of the shaft. In comparison, prior art putters typically have a balance point which is only 5 or 6 inches from the blade rather than near the mid-point of the putter. The amount of supplementary weight added in the handle section as well as its specific location together determine the desired position of the balance point which can easily be adjusted to accommodate the golfer's preference. Supplementary weighting of from 15% –40% of the total weight of the putter is contemplated. For example, 115 grams of added weight (about 20%) would be used in the putter mentioned above which, in absence of a grip, weighed 435 grams. In order to eliminate the pinging sound made when a ball is struck with a putter having a hollow metal shaft of the present invention, vibration dampening filler can be placed into the shaft at selected locations following which the open butt end of the shaft is plugged to prevent entry of dirt and act as an end cap.

Persons skilled in the art will readily appreciate that various modifications can be made from the preferred embodiment thus the scope of protection is intended to be defined only by the limitations of the appended claims.

I claim:

1. A hollow shaft for a golf putter, said shaft having a generally circular cross-section comprising:

a tip section;

a handle section having a substantially flat side for engaging the thumbs of the user and a convex side opposite said flat side comprising a portion of said generally circular cross section; and a tapered section interconnecting said tip section and said handle section, said sections being integrally formed from a single piece of metal, said substantially flat side of said handle section having a width, measured in a plane generally perpendicular to the plane of a putter blade when affixed to the shaft, of not less than 0.930 inch.

2. The hollow shaft of claim 1, wherein said shaft is aluminum alloy.

3. The shaft of claim 2, wherein said handle section has a generally D-shaped cross-section and said tip section and said tapered sections of said shaft each have a generally circular cross section.

4. The shaft of claim 3, wherein said handle section has a roughened finish.

5. The shaft of claim 1, further comprising supplementary weight inside said handle section of said hollow shaft.

6. The shaft of claim 1, wherein said shaft has a total length L of from 32 inches to 38 inches.

7. A golf putter comprising:

a putter blade having a ball striking face generally lying in a striking plane; and a hollow shaft having a generally circular cross-section comprising:

a tip section to which said putter blade is affixed;

a handle section having a substantially flat side for engaging the thumbs of the user and a convex side opposite said flat side comprising a portion of said generally circular cross-section; and a tapered section interconnecting said tip section and said handle section, said sections being integrally formed from a single piece of metal, said substantially flat side of said handle section having a width, measured in a plane generally perpendicular to the plane of said putter blade, of not less than 0.930 inch.

8. The putter of claim 7, wherein said shaft is aluminum alloy.

9. The putter of claim 8, wherein said handle section has a generally D-shaped cross-section and said tip section and said tapered sections of said shaft each have a generally circular cross section.

10. The putter of claim 9, wherein said handle section has a roughened finish.

11. The putter of claim 8, further comprising added weight in said handle section such that the longitudinal balance point of said putter is located a distance D measured from the tip end of said shaft of from 40% to 60% of the length L of said shaft.

12. The putter of claim 11, wherein said added weight in said handle section comprises from 15%–40% of the total weight of said putter.

13. The putter of claim 12, wherein said shaft has a total length L of from 32 inches to 38 inches.

* * * * *